US008125294B2

(12) United States Patent
Foged et al.

(10) Patent No.: US 8,125,294 B2
(45) Date of Patent: Feb. 28, 2012

(54) ORTHOGONAL-MODE JUNCTION COUPLER HAVING A DIPOLE RADIATING STRUCTURE AND METHOD OF COUPLING

(75) Inventors: Lars Foged, Apilia (IT); Andrea Giacomini, Albano Laziale (IT)

(73) Assignee: Ste d'Applications Technologiques de l'Imagerie Micro-Onde, Villebon sur Yvette (FR)

( * ) Notice: Subject to any disclaimer, the term of this patent is extended or adjusted under 35 U.S.C. 154(b) by 128 days.

(21) Appl. No.: 12/446,973

(22) PCT Filed: Oct. 18, 2007

(86) PCT No.: PCT/EP2007/061135

§ 371 (c)(1),
(2), (4) Date: Apr. 23, 2009

(87) PCT Pub. No.: WO2008/049778

PCT Pub. Date: May 2, 2008

(65) Prior Publication Data

US 2010/0090779 A1 Apr. 15, 2010

(30) Foreign Application Priority Data

Oct. 24, 2006 (FR) ..... 06 09334

(51) Int. Cl.
*H01P 1/161* (2006.01)

(52) U.S. Cl. ..... 333/125; 333/137; 333/26; 333/21 A

(58) Field of Classification Search ..... 333/21 A, 333/125, 126, 135, 137, 26
See application file for complete search history.

(56) References Cited

U.S. PATENT DOCUMENTS 2,885,542 A * 5/1959 Sichak ..... 455/504
(Continued)

FOREIGN PATENT DOCUMENTS

JP 01-200802 A 8/1989
(Continued)

OTHER PUBLICATIONS

Karmakar, N. et al., "Investigations Into a Circular Patch Antenna in a Cylindrical Cavity Enclosure," Singapore ICCS '94, IEEE, vol. 2, (Nov. 14, 1994) pp. 446-450.

*Primary Examiner* — Benny Lee
(74) *Attorney, Agent, or Firm* — Blakely, Sokoloff, Taylor & Zafman

(57) ABSTRACT

Orthogonal-mode junction coupler with a medium to broad bandwidth for a waveguide (1) operating at a wavelength λ, characterized in that it includes a connector (5) projecting from the waveguide (1) and extending between a short circuit (3) of the waveguide (1) and a conducting structure (6) acting as dipole radiating at a wavelength of approximately λ/2 excited at its central point by the connector.

5 Claims, 3 Drawing Sheets

U.S. PATENT DOCUMENTS

| | | | | | |
|---|---|---|---|---|---|
| 3,170,128 | A | * | 2/1965 | Eason et al. | 333/26 |
| 3,990,026 | A | | 11/1976 | Barlow | |
| 5,115,214 | A | * | 5/1992 | Gassmann et al. | 333/26 |
| H1959 | H | * | 5/2001 | Kikel | 342/51 |

FOREIGN PATENT DOCUMENTS

| | | | |
|---|---|---|---|
| JP | 05-206702 | A | 8/1993 |

* cited by examiner

ORTHOGONAL-MODE JUNCTION COUPLER HAVING A DIPOLE RADIATING STRUCTURE AND METHOD OF COUPLING

The present patent application is a Utility claiming the benefit of Application No. PCT/EP2007/061135, filed Oct. 18, 2007.

FIELD OF THE INVENTION

The present invention concerns a coupling method and a coupler implementing the method in order to separate dual-polarization bands propagating into a horn antenna, for example.

BACKGROUND OF THE INVENTION

In the field of radiofrequency antennas, it is well known to use orthogonal-mode junction couplers, or "ortho-mode junction" (OMJ) couplers, to separate dual-polarization bands.

For medium to broad operating band frequencies, these orthogonal-mode junction couplers are traditionally made up of a supply section of the waveguide comprising orthogonal supply points placed along the axis of the coupler, the points being offset along the axis of the coupler. The supply points are generally realized using connectors, grooves or any other equivalent means well known by One Skilled in the Art.

This type of coupler has the drawback of providing poor isolation between the various inlet ports of the supply points which are close to each other.

Furthermore, this type of coupler has an asymmetry which leads to degradation of the purity of the modal network due to the excitation of higher order modes.

In order to offset the coupling appearing between the different inlet ports of these couplers, it is well known to use an external compensating circuit ensuring supplying of the inlet ports. However, these compensating circuits do not allow the elimination of all errors.

SUMMARY OF THE INVENTION

One of the aims of the invention is therefore to resolve all of these drawbacks by proposing a coupling method and a coupler implementing the method obtaining weak coupling between the ports for medium to broad frequency bands without requiring an external compensating circuit.

According to the invention, what is proposed is an orthogonal-mode junction coupling method with a medium to broad bandwidth for a waveguide operating at a wavelength λ, the method being remarkable in that it consists of capacitively supplying a conducting structure integral with the waveguide through a connector projecting inside the waveguide and extending between a short circuit of the waveguide and the conducting structure.

Another object concerns an orthogonal-mode junction coupler with a medium to broad bandwidth for a waveguide operating at a wavelength λ, which is remarkable in that the coupler comprises a connector projecting from the waveguide and extending between a short circuit of the waveguide and a conducting structure acting as a dipole radiating at the wavelength λ/2 excited at its central point by the connector.

The connector consists of a conducting rod electrically isolated from the waveguide and capacitively supplying the conducting structure.

Furthermore, the conducting structure consists of two fins, C-shaped or U-shaped, extending symmetrically on either side of the plane of symmetry of the waveguide, each fin comprising a first branch integral with the waveguide and extending above the connector and parallel thereto toward the plane of symmetry of the waveguide, and a second branch extending parallel to the first branch above the first branch, the branches being connected by a vertical base extending perpendicularly to the connector.

The distance separating the short circuit of the waveguide of the lower connector is approximately equal to one quarter the wavelength λ of the waveguide.

The distance separating the lower connector from the upper connector is also approximately equal to one quarter of the wavelength λ of the waveguide. The upper connector uses a virtual short circuit located under the upper part in the waveguide (for example made using a rod parallel to the connector connected at both ends to the walls of the waveguide; which depicts a non limitative and exemplary embodiment).

In order to avoid the appearance of a parasitic mode in the waveguide, the coupler comprises a filter positioned between the two orthogonal excitation assemblies (filters made for example using rods connected at both ends to the walls of the waveguide).

It is understood that in order to obtain two orthogonal polarizations, one advantageously needs two conducting structure plus connector assemblies, each assembly being orthogonal and placed so as to be superimposed with a distance of approximately lambda/4 (λ/4) between the lower connector and the upper connector.

BRIEF DESCRIPTION OF THE DRAWINGS

Other advantages and characteristics will better emerge from the description which follows, of a single embodiment provided as a non-limiting example, of the orthogonal-mode junction coupler, in particular coaxial, with a medium to broad bandwidth according to the invention, from the appended drawings in which.

DETAILED DESCRIPTION OF THE INVENTION

Below is an OMJ coupler with a medium and broad bandwidth according to the invention in order to separate orthogonal dual-polarization bands of a coaxial circular radiating horn or filled with a dielectric cone; however, it is obvious that the coupler according to the invention may be used alone and/or in any other application well known by One Skilled in the Art.

Figure 1:
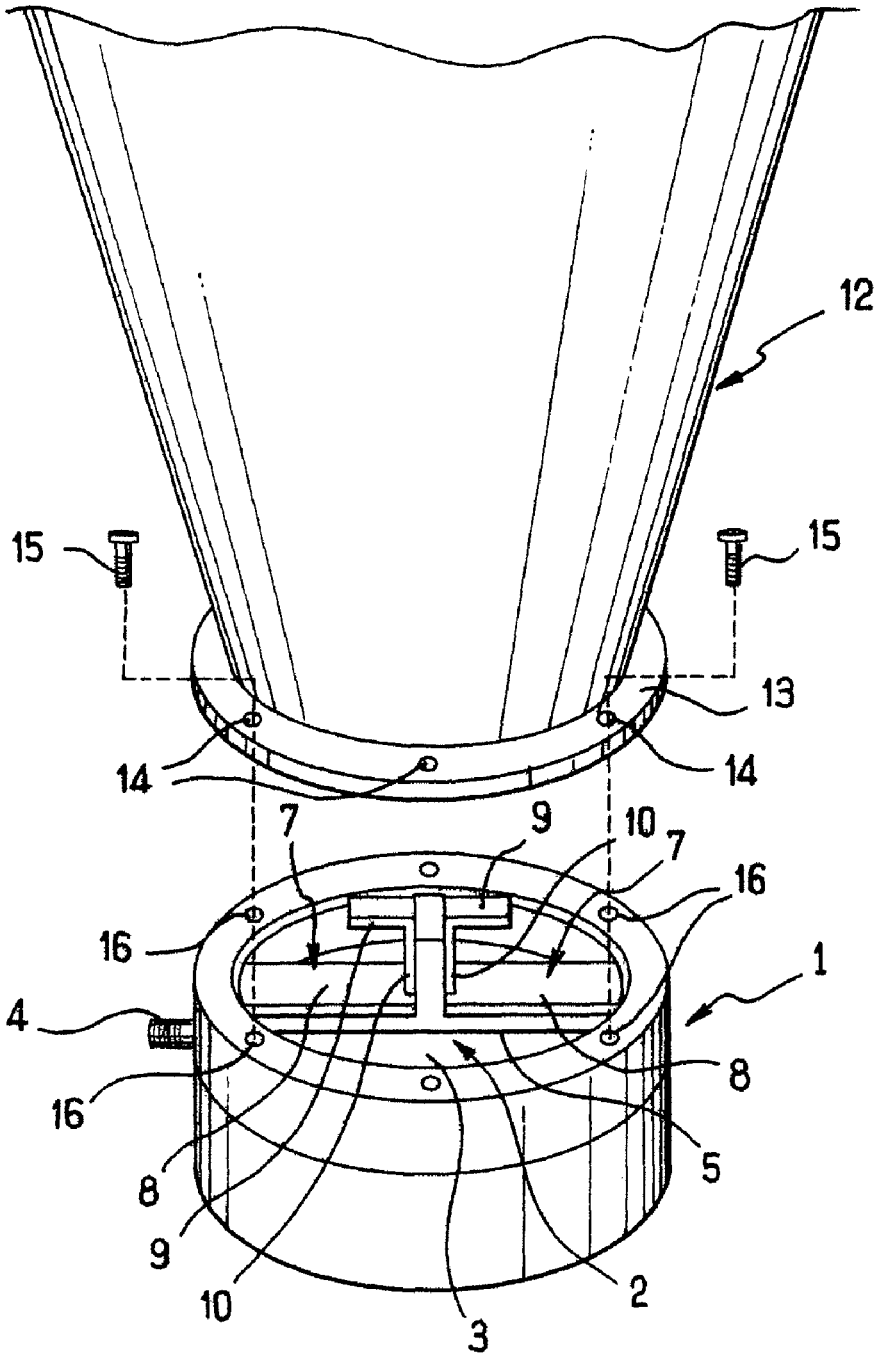
FIG. 1 is an exploded perspective view of the coupler according to the invention mounted with a horn antenna.
Figure 2:
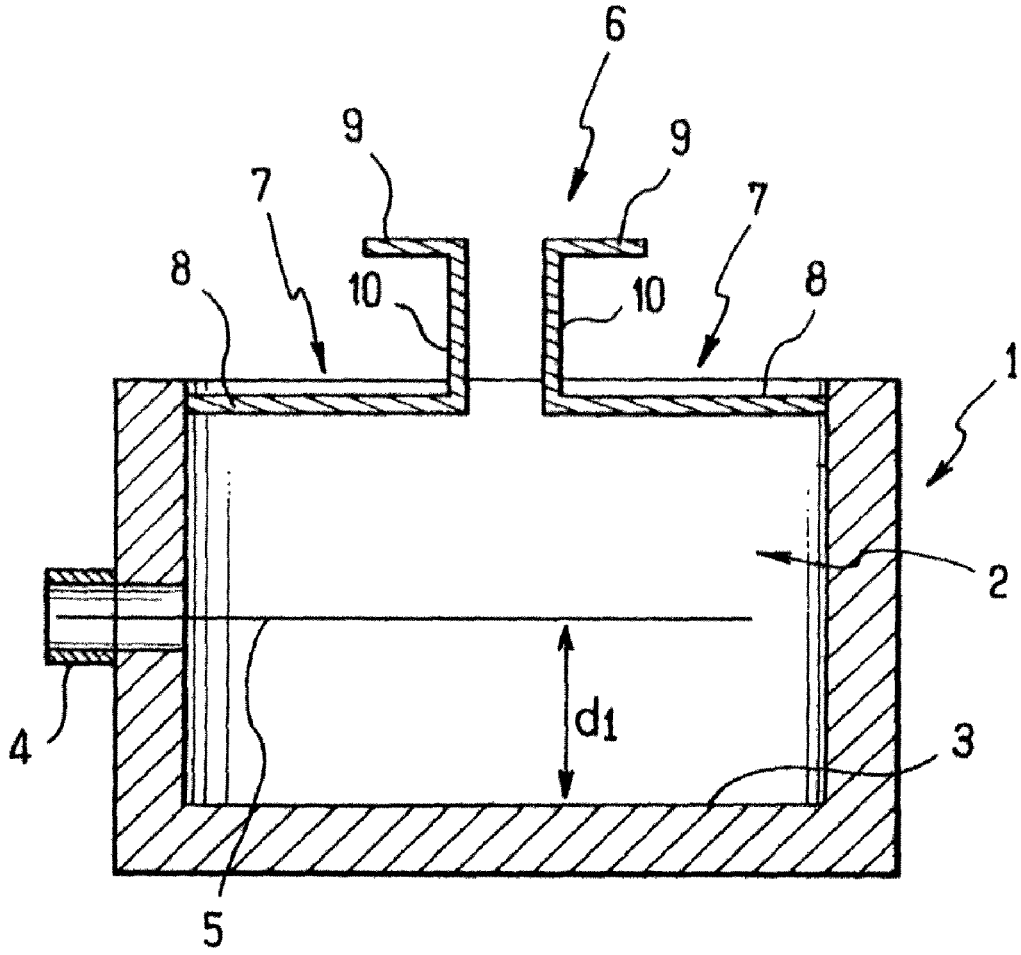
FIG. 2 is a diagrammatic radial cross-sectional view of the coupler according to the invention illustrated in FIG. 1.

In reference to FIGS. 1 and 2, the coupler according to the invention is made up of a cylindrical waveguide 1 comprising a coaxial cylindrical cavity 2 the bottom of which forms a short circuit 3 of the waveguide 1.

The waveguide comprises, on a lateral wall thereof, an inlet port 4 from which a connector projects, the connector consisting of a conducting rod 5 electrically isolated from the waveguide, the conducting rod 5 being electrically isolated at radiofrequencies and electrically coupled to a discontinuous current. This conducting rod 5 emerges in the cylindrical cavity 2 of the waveguide 1 while extending diametrically in the cavity. The distance $d_1$ separating the conducting rod 5 from the short circuit 3 of the waveguide is approximately equal to one quarter of the wavelength λ of the waveguide 1, or $d_1=\lambda/4$, as shown in FIG. 2.

Furthermore, the waveguide 1 comprises, near an upper end thereof, a conducting structure 6 (FIG. 2) acting as a dipole radiating at the wavelength λ/2.

This conducting structure 6 consists of two fins 7, C-shaped or U-shaped, extending symmetrically on either side of the axis of revolution of the waveguide 1, and more precisely symmetrically on either side of the plane of symmetry of the waveguide 1 extending orthogonally to the conducting rod 5 and passing through the axis of revolution of the waveguide 1.

Each fin 7 comprises a first, so-called lower branch integral with the waveguide 1 and extending above the conducting rod 5 and parallel thereto toward the plane of symmetry of the waveguide 1 and a second, so-called upper branch 9, shorter than the lower branch 8, extending parallel to and above the lower branch 8, the branches 8 and 9 being connected by a vertical base 10 extending perpendicular to the conducting rod 5.

The conducting structure 6 will advantageously be obtained in a metallic material.

Secondarily, in order to avoid the appearance of a parasite mode in the waveguide 1, the waveguide comprises a filter positioned between the two orthogonal excitation structures.

Figure 3:
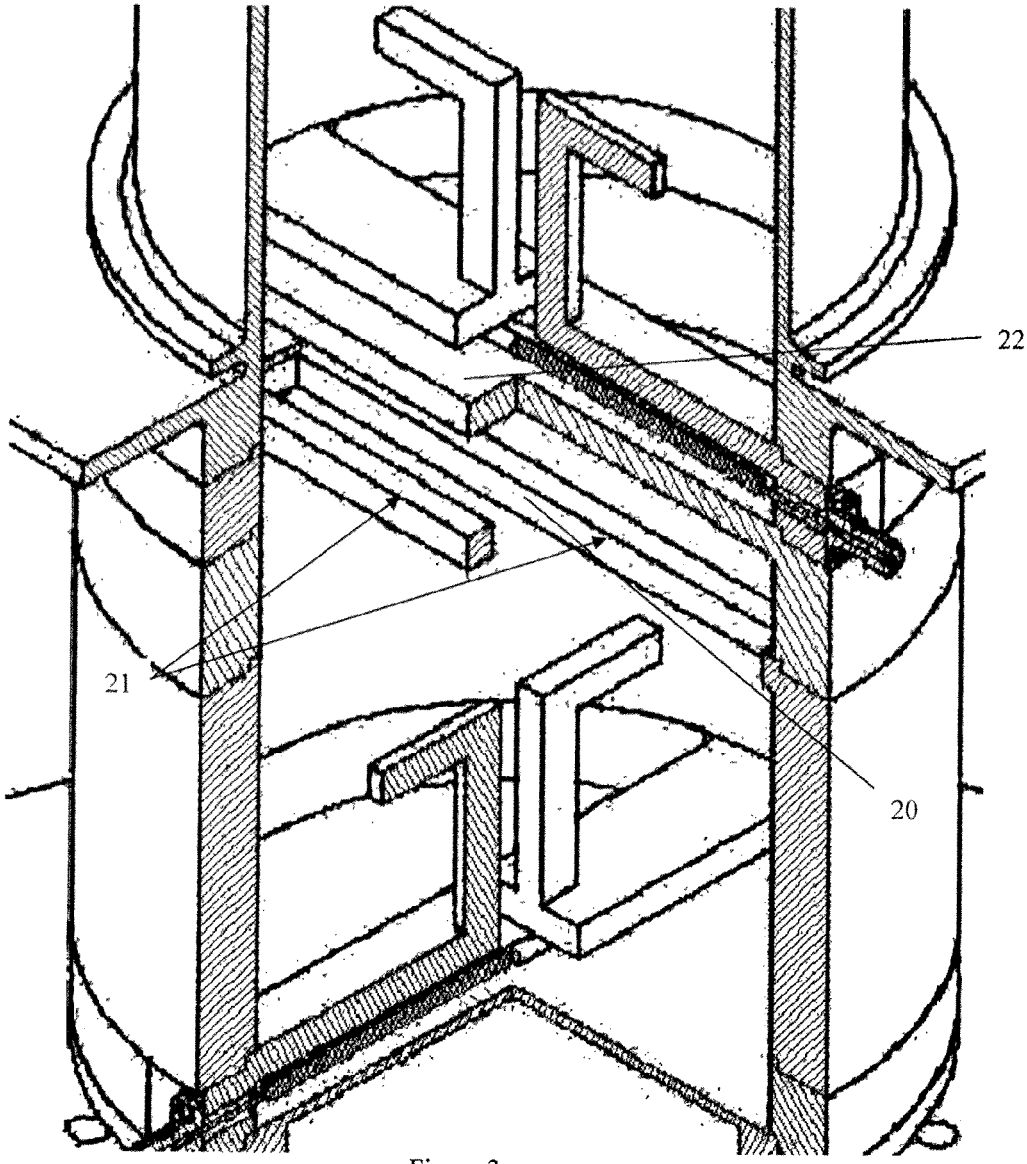
FIG. 3 is an exemplary and non-limitative embodiment of a coupler comprising two superimposed orthogonal excitation assemblies.

It is obvious that the filter 21 (cf. FIG. 3, which depicts a non limitative and exemplary embodiment) may consist of several conducting rods 20 and 22, the ends of conducting rods 20 are connected to the waveguide or any other equivalent means well known by One Skilled in the Art without going beyond the scope of invention.

Thus, the conducting rod 5 capacitively supplies the conducting structure 6 such that an excitation current runs through the upper branches 9 of the conducting structure 6, the excitation currents being illustrated by arrows in FIG. 2. The excitation currents of the upper branches 9 correspond to the distribution of the currents on an equivalent dipole. In reference to FIG. 1, an antenna horn 12 comprising a flange 13 at the base thereof provided with a hole 14 that is secured to the end of the coupler using screws 15 cooperating with threaded holes 16 formed on the upper edge of the waveguide 1.

A coaxial orthogonal-mode junction coupler of this type operating on a medium to broad frequency band obtains weak coupling between the ports such that an external compensating circuit is not necessary.

It is obvious that the coupler according to the invention may be obtained according to a precision trimming method well known by One Skilled in the Art or a method for manufacturing a multi-layer printed circuit, the multi-layer printed circuit being integrated into a waveguide, without, however, going beyond the scope of the invention.

Lastly, it goes without saying that the orthogonal-mode junction (OMJ) coupler with a medium or broad bandwidth according to the invention may be adapted for any other application well known by One Skilled in the Art and that the examples which were just provided are in no way limiting as to the fields of application of the invention.

The invention claimed is:

1. An orthogonal-mode junction coupler with a medium to broad bandwidth for a waveguide operating at a wavelength λ, wherein the coupler comprises a connector projecting from the waveguide and extending between a short circuit of the waveguide and a conducting structure acting as a dipole radiating at a wavelength of approximately λ/2 excited at a central point of the dipole by the connector.

2. The orthogonal-mode junction connector according to claim 1 wherein the connector consists of a conducting rod electrically isolated from the waveguide and capacitively supplying the conducting structure.

3. The orthogonal-mode junction connector according to any one of claims 1 or 2 wherein the conducting structure consists of two fins, C-shaped or U-shaped, extending symmetrically on either side of a plane of symmetry of the waveguide, each fin comprising a first branch integral with the waveguide and extending above the connector and parallel thereto toward the plane of symmetry of said waveguide and a second branch extending parallel to the first branch above the first branch, said first and second branches of each fin being connected by a vertical base extending perpendicularly to the connector.

4. The orthogonal-mode junction connector according to any one of claims 1 or 2, wherein a distance $d_1$ separating the short circuit of the waveguide from the connector is approximately equal to one quarter of the wavelength λ of the waveguide.

5. A method of orthogonal-mode junction coupling with a medium to broad operating bandwidth for a waveguide with a wavelength λ, the method comprising:

capacitively supplying a conducting structure integral with the waveguide through a connector projecting inside the waveguide and extending between a short circuit of said waveguide and the conducting structure, the conducting structure acting as a dipole radiating at a wavelength of approximately λ/2 excited at a central point of the dipole by the connector.

* * * * *